US010973304B2

(12) United States Patent
Cho et al.

(10) Patent No.: US 10,973,304 B2
(45) Date of Patent: Apr. 13, 2021

(54) FINGER MASCARA

(71) Applicant: AMOREPACIFIC CORPORATION, Seoul (KR)

(72) Inventors: Yeon Ju Cho, Yongin-si (KR); Hae Won Jeong, Yongin-si (KR); Eun Sil Han, Yongin-si (KR); Hyun Woo Roh, Yongin-si (KR)

(73) Assignee: AMOREPACIFIC CORPORATION, Seoul (KR)

( * ) Notice: Subject to any disclaimer, the term of this patent is extended or adjusted under 35 U.S.C. 154(b) by 25 days.

(21) Appl. No.: 16/476,267

(22) PCT Filed: Jan. 5, 2018

(86) PCT No.: PCT/KR2018/000262
§ 371 (c)(1),
(2) Date: Jul. 5, 2019

(87) PCT Pub. No.: WO2018/128464
PCT Pub. Date: Jul. 12, 2018

(65) Prior Publication Data

US 2019/0350341 A1 Nov. 21, 2019

(30) Foreign Application Priority Data

Jan. 5, 2017 (KR) ..... 10-2017-0001921

(51) Int. Cl.
*A45D 40/26* (2006.01)
*A46B 5/04* (2006.01)

(52) U.S. Cl.
CPC ..... *A45D 40/267* (2013.01); *A45D 40/264* (2013.01); *A46B 5/04* (2013.01); *A45D 2200/053* (2013.01)

(58) Field of Classification Search
CPC .. A45D 34/042; A45D 34/045; A45D 34/046; A45D 40/262; A45D 40/265;
(Continued)

(56) References Cited

U.S. PATENT DOCUMENTS 2,151,846 A * 3/1939 Greneker ..... B43K 23/012 81/177.3
2,883,691 A * 4/1959 Gruenwald ..... A46B 5/04 15/167.1
(Continued)

FOREIGN PATENT DOCUMENTS

CN 205813895 U 12/2016
JP 3445220 B2 9/2003
(Continued)

OTHER PUBLICATIONS

Korean Office Action for Application No. 10-2017-0001921 dated Sep. 27, 2017.
(Continued)

*Primary Examiner* — David P Angwin
*Assistant Examiner* — Bradley S Oliver
(74) *Attorney, Agent, or Firm* — Cantor Colburn LLP

(57) ABSTRACT

Finger mascara includes: a container for containing a cosmetic material; an application unit coupled to the container; and a middle unit for detachably coupling the application unit to the container. The application unit includes: a finger insertion part in which a user can insert a finger from above; an outer cylinder surrounding the periphery of the finger insertion part and having an upward opening; a plurality of elastic supporting parts extending upward from the outer cylinder and capable of wrapping the finger inserted from above and being elastically transformed in a direction away from a central axis of the outer cylinder as the finger is inserted; a stick extending downward from one point of the
(Continued)

inner space of the outer cylinder; and a brush for applying cosmetic material by coating the same thereon, wherein a free end of the elastic supporting parts is provided with a tip.

15 Claims, 9 Drawing Sheets

(58) Field of Classification Search
CPC ..... A45D 40/267; A46B 5/04; B43K 23/012; B65D 41/17
USPC ..... 401/7; D19/158
See application file for complete search history.

(56) References Cited

U.S. PATENT DOCUMENTS 3,430,798 A * 3/1969 Goyet ..... B65D 41/17 215/295
4,051,974 A * 10/1977 Gentile ..... B65D 41/17 215/329
D254,035 S * 1/1980 Gueret ..... D28/7
4,213,472 A * 7/1980 Gueret ..... A45D 40/26 132/320
4,679,274 A * 7/1987 Friedman ..... A46B 5/04 15/167.1
5,242,232 A * 9/1993 Kuhn ..... B65D 51/32 401/122
5,604,952 A * 2/1997 Zeleznick ..... A46B 3/18 15/167.1
8,662,091 B2 * 3/2014 Jang ..... A46B 5/04 132/320
9,033,603 B2 * 5/2015 Vanoncini ..... A45D 40/265 401/126
9,375,072 B2 * 6/2016 Drugeon ..... A45D 40/26
9,730,505 B2 * 8/2017 Jouan ..... A45D 40/267
10,413,040 B2 * 9/2019 Jeong ..... A45D 34/043
10,485,309 B1 * 11/2019 Bonner ..... B65D 43/02
10,646,020 B2 * 5/2020 Jeong ..... A45D 40/264
10,729,229 B2 * 8/2020 Mouraret ..... B29C 64/20
2005/0199655 A1 * 9/2005 Petit ..... B65D 41/17 222/546
2006/0243295 A1 * 11/2006 Petit ..... A45D 40/262 132/320
2009/0035048 A1 * 2/2009 Safieh ..... A46B 5/04 401/7
2010/0143019 A1 * 6/2010 Merla, Jr. ..... A46B 5/04 401/7
2011/0123253 A1 * 5/2011 Matsui ..... A46B 5/04 401/269
2013/0020340 A1 * 1/2013 Geuther ..... A45D 40/00 220/780
2015/0165813 A1 * 6/2015 Martin ..... B43K 7/06 29/428
2017/0127802 A1 * 5/2017 Chen ..... A45D 40/00
2018/0168319 A1 6/2018 Jeong et al.
2020/0022481 A1 * 1/2020 Cho ..... A45D 34/00
2020/0061799 A1 * 2/2020 Fryshman ..... A46B 5/04

FOREIGN PATENT DOCUMENTS

JP 2005111959 A 4/2005
KR 2020090005979 U 6/2009
KR 2020110004519 U 5/2011
KR 200476610 Y1 3/2015

OTHER PUBLICATIONS

International Search Report for PCT/KR2018/000262 dated Apr. 12, 2018.
Written Opinion for PCT/KR2018/000262 dated Apr. 12, 2018.
European Search Report for Application No. 18736193 dated Sep. 28, 2020.

* cited by examiner

【FIG. 1】
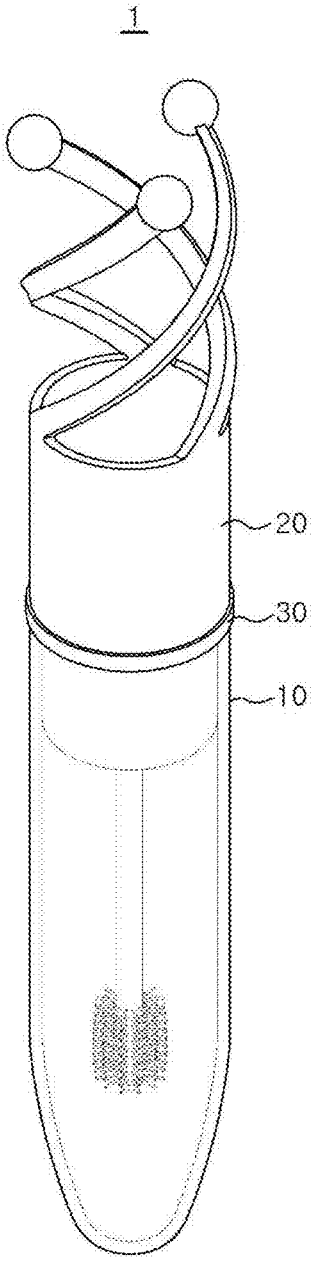

【FIG. 2】
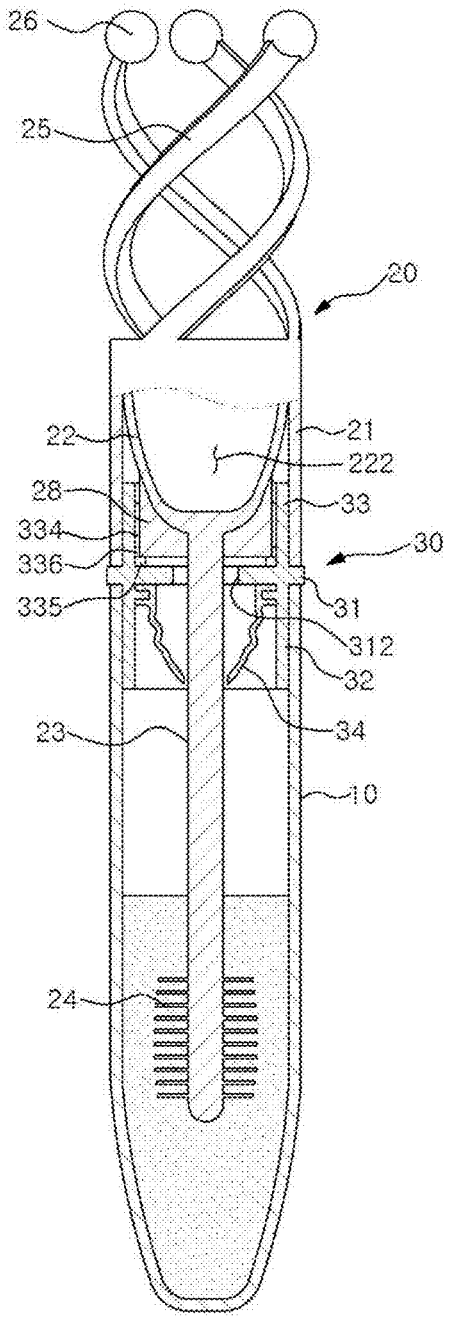

【FIG. 3】
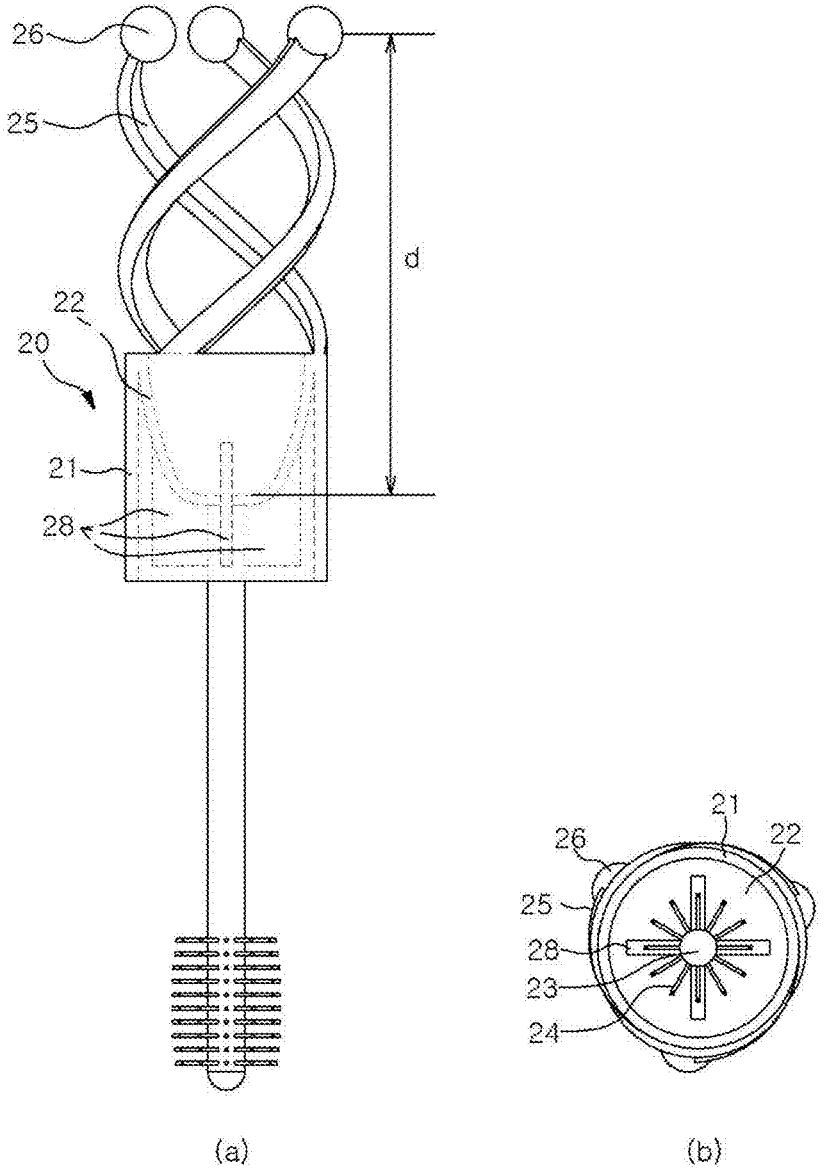

【FIG. 4】
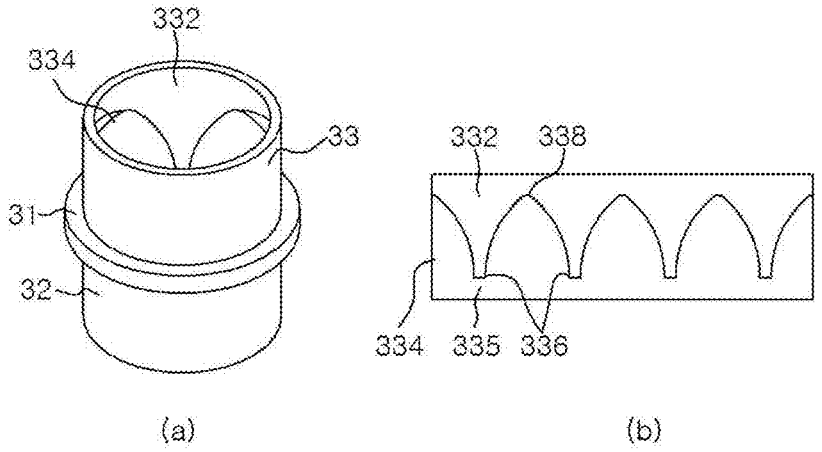
【FIG. 5】
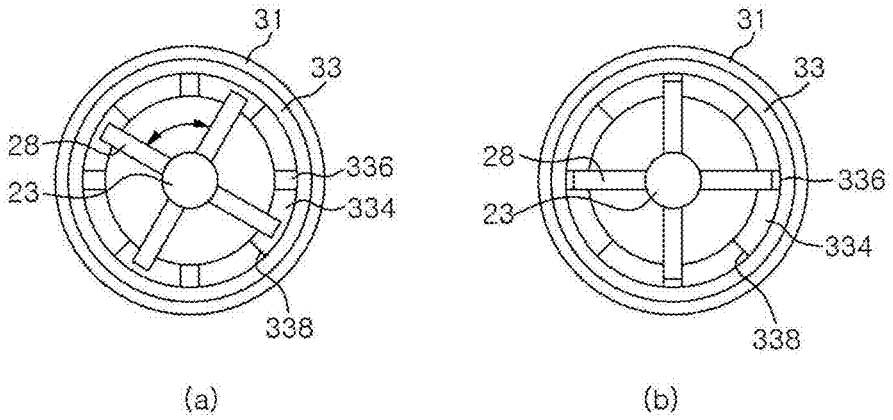

【FIG. 6】
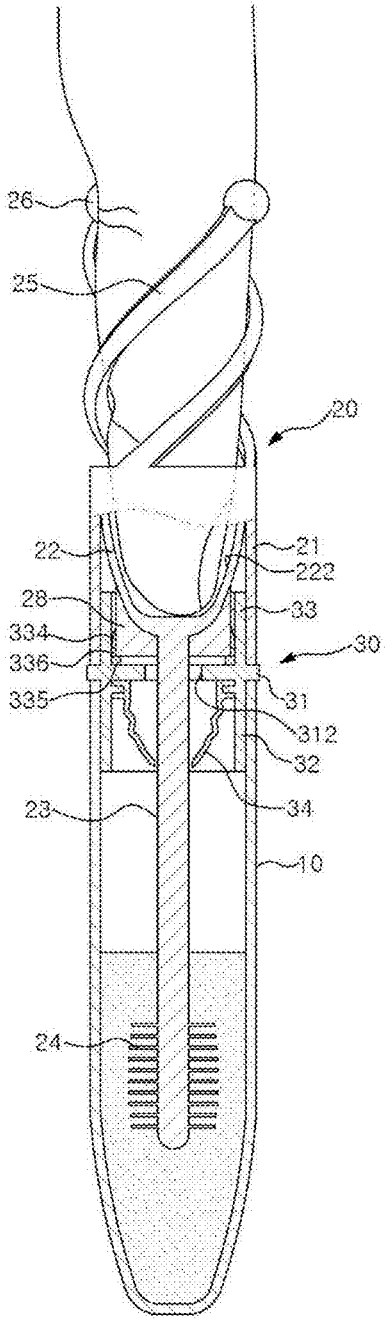

【FIG. 7】
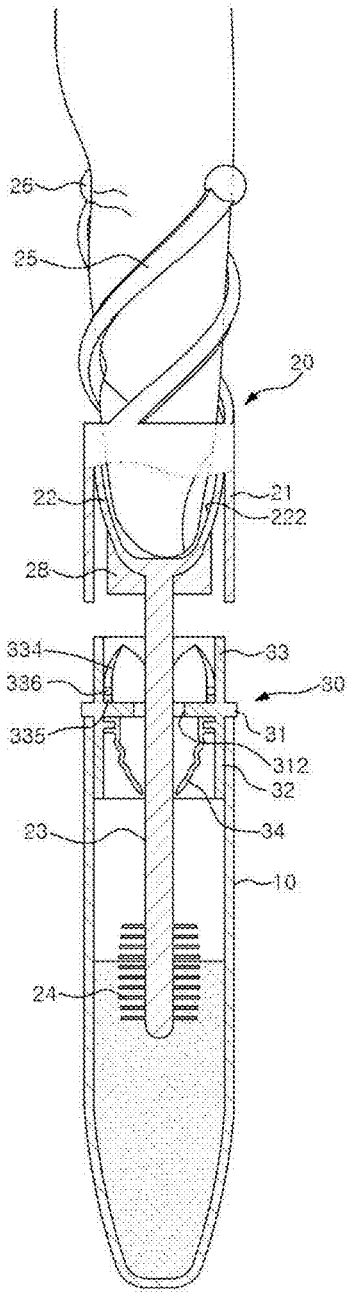

【FIG. 8】
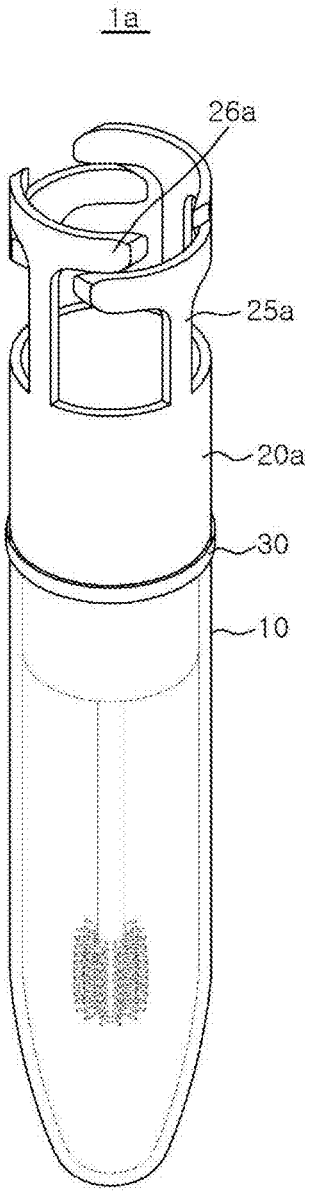

【FIG. 9】
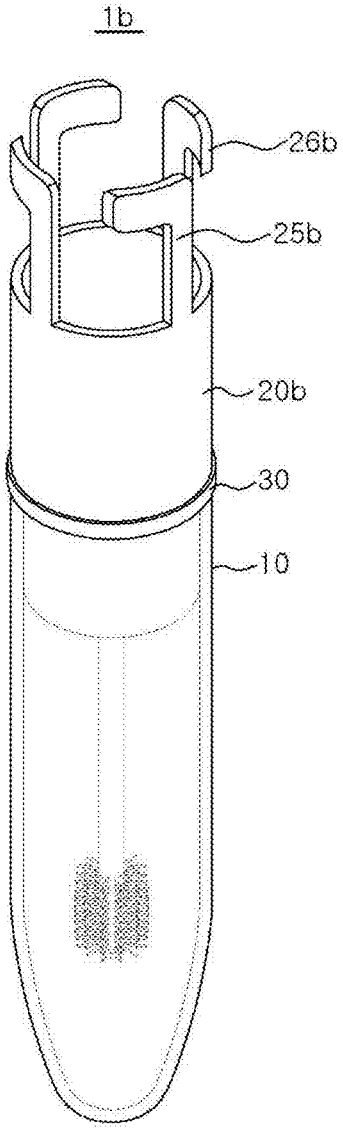

【FIG. 10】
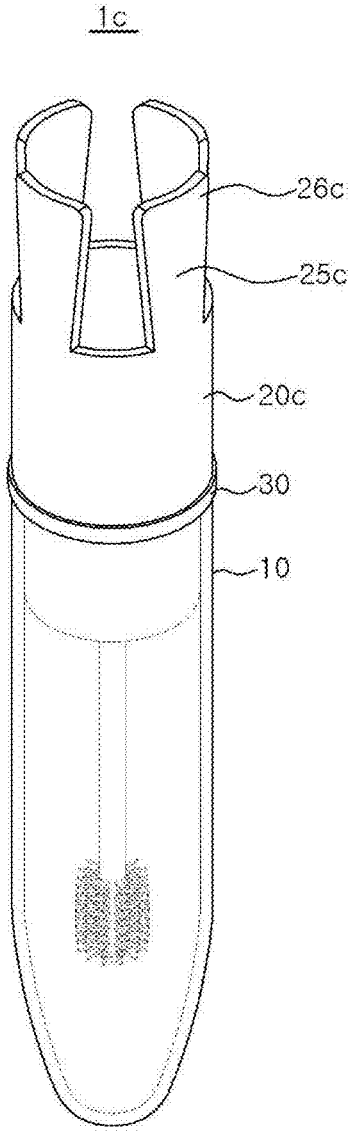

FINGER MASCARA

TECHNICAL FIELD

The present invention relates to a finger mascara.

BACKGROUND ART

Make-up cosmetics are cosmetics which are applied on a body such as a face or nails to lent a splash of color and make skin color beautiful after a basic product is used, and which conceal skin defects which cannot be covered by the basic product. For example, the make-up cosmetics may be classified as a base make-up which can unify the color of the skin of an entire face or cover skin defects such as melasma and freckle, thereby fixing a skin healthily and beautifully, and a point make-up which locally highlights or shades lip, eye, cheeks, nail or the like to deliver a three-dimensional effect, thus expressing his or her individuality. The base make-up includes, for example, make-up base, foundation, powder and the like, and the point make-up include, for example, lip stick, eye liner, mascara and the like.

The mascara, which is one of the point make-ups, is a cosmetic for highlighting eyelashes, and is used in a method in which a cosmetic material is coated on a brush and applied on eyelashes.

Such mascara is generally constituted by a container in which a cosmetic material is contained, and a lid to which a stick and a brush are integrally coupled. When consumers open the lid, the brush coated with cosmetic material is extracted, and a user can do make-up by applying the cosmetic material coated on the brush on the eyelashes while holding the lid.

However, as a user must do eyelash make-up while holding the lid by the hand, it is difficult to do precise eyelash make-up with a general mascara. Further, if a user inadvertently misses the lid held with the hand when doing make-up, a problem that the brush becomes dirty may occur.

In order to address aforementioned problem, Korean Utility Model Registered No. 20-0218237 has been proposed. Korean Utility Model Registered No. 20-0218237 relates to a finger insertion brush, wherein by coupling a brush stick 6 with a finger insertion device 1 in which a finger insertion part 2 is formed, a user can do make-up with only a finger without holding an application device.

However, according to Korean Utility Model Registered No. 20-0218237, the finger insertion part 1 is manufactured so as to have a fixed size, and thus users having a finger thickness different from the finger insertion part experienced inconvenience that inserting the finger into the finger insertion part 1 was limited.

In order to address aforementioned problems, Korean Utility Model Registered No. 20-0459829 has been proposed. According to Korean Utility Model Registered No. 20-0459829, there is proposed a make-up device set for disabled person, in which a thimble 112 for finger insertion is formed under the elastic supporting part 118 of a coil spring shape extended in a finger insertion direction, a brush stick 114 and an application tip 116 are formed under the thimble 112, and thus elastic deformation of the elastic supporting part 118 enables users having different finger thickness to use.

However, according to Korean Utility Model Registered No. 20-0459829, the finger is fixed with only one elastic supporting part 118, and thus the finger and the thimble 112 do not fixed firmly, which leads to a problem that precise make-up is difficult due to the shaking of the application tip 116.

Further, the thimble 112 of Korean Utility Model Registered No. 20-0459829 is exposed directly to outside, and there is problem that an outer surface of the thimble 112 and a seat slot 122 of the storage box 120 become dirty by the cosmetic material when the brush stick 114 and application tip 16 are entered and extracted into/from the storage box 120 in which a cosmetic material is stored. Particularly, if the outer surface of the thimble 112 is contaminated, a problem that a cosmetic material is smeared on a facial part which a user does not want during a make-up may occur.

Further, as the thimble 112 of Korean Utility Model Registered No. 20-0459829 is simply rested on and fixed to the storage box 120, the fixing state is very unstable, and thus it can be separated from the storage box 120 by a slight external force, which may problematically lead to contamination of the thimble 112, the brush stick 114, the application tip 116.

DISCLOSURE

Technical Problem

Exemplary embodiments of the invention are proposed in order to address the problems described above, and are to provide a finger mascara which users having different finger sizes can use.

Further, they are to provide a finger mascara which can be firmly secured to a finger.

Further, they are to provide a finger mascara which can prevent a problem that due to contamination of an outer surface of an application unit by a cosmetic material, on a body portion which a user does not want is smeared with the cosmetic material.

Further, they are to provide a finger mascara which can couple and separate an application to/from a container simply and conveniently.

Technical Solution

In accordance with an aspect of the present disclosure, there is provided a finger mascara comprising: a container in which a cosmetic material for eyelash make-up is contained and whose upper end is opened; an application unit which is coupled to an upper end of the container and into which a user can insert his/her finger to apply a cosmetic material; and a middle unit removably coupling the application unit to the container, wherein the application unit includes, a finger insertion part which provides an insertion space into which the user can insert the finger from an upper side thereof; an outer cylinder which surrounds around the finger insertion part and whose upper end is opened; a plurality of elastic supporting parts which are extended upward from the outer cylinder, capable of wrapping around the finger to be inserted into from the upper side, and can be elastically deformed in a direction away from a central axis of the outer cylinder as the finger is inserted into; a stick extended downward from a point within the inner space of the outer cylinder; and a brush which is capable of being coated with and applying the cosmetic material, wherein at a free end of the elastic supporting part, there is provided a tip which is formed so as to be more protruding toward the finger than the elastic supporting part, or which is extended to one side or both sides, or which is formed with a wider area in a width direction than the elastic supporting part.

In an embodiment of the finger mascara, wherein the elastic supporting parts are disposed along the periphery of the outer cylinder at a constant interval therebetween.

In an embodiment of the finger mascara, wherein the elastic supporting part is extended in a spiral shape in a circumferential direction of the finger.

In an embodiment of the finger mascara, wherein some of the plurality of elastic supporting parts are formed to have lengths different from each other.

In an embodiment of the finger mascara, wherein some of the plurality of elastic supporting parts are arranged so as to overlap each other in a length direction of the finger.

In an embodiment of the finger mascara, wherein a distance from a lower point of the finger insertion part to a center of the tip is from 2 cm to 5 cm.

In accordance with another aspect of the present disclosure, there is provided a finger mascara comprising: a container in which a cosmetic material for eyelash make-up is contained and whose upper end is opened; an application unit which is coupled to an upper end of the container and into which a user can insert his/her finger to apply a cosmetic material; and a middle unit removably coupling the application unit to the container, wherein the application unit includes, a finger insertion part which provides an insertion space into which the user can insert the finger from an upper side thereof; an outer cylinder which surrounds around the finger insertion part and whose upper end is opened; a plurality of elastic supporting parts which are extended upward from the outer cylinder, capable of wrapping around the finger to be inserted into from the upper side, and can be elastically deformed in a direction away from a central axis of the outer cylinder as the finger is inserted into; a stick extended downward from a point within the inner space of the outer cylinder; and a brush which is capable of being coated with and applying the cosmetic material, wherein the middle unit includes, a base provided between the container and the application unit, and provided with a through hole through which the stick and the brush pass; a lower rib which is extended to a lower side of the base to be coupled to the container; and an upper rib which is extended to an upper side of the base to be inserted into an inner side of the outer cylinder, wherein the upper rib is inserted into a space between the finger insertion part and the outer cylinder.

In an embodiment of the finger mascara, wherein a plurality of coupling ribs are provided around the stick, wherein on an inner circumferential surface of the upper rib, there are provided a plurality of coupling slots into which the coupling rib is selectively inserted.

In an embodiment of the finger mascara, wherein the outer cylinder is formed so as to have a height equal to or lower than an end portion of the coupling rib.

In an embodiment of the finger mascara, wherein on an inner circumferential surface of the upper rib, a guide which guides movement of the coupling rib is protrudingly formed from the inner circumferential surface, wherein the guide is provided between the coupling slots to include a plurality of guide surface, wherein the guide surface is provided with an inclined surface extended to the coupling slots of both sides with respect to a summit point located between the coupling slots.

In an embodiment of the finger mascara, wherein the coupling rib is configured to be elastically deformed and extracted from the coupling slot by a rotational force applied to the outer cylinder, wherein the coupling rib goes up along the guide surface after having been extracted from the coupling slot.

In an embodiment of the finger mascara, wherein the coupling rib has a plate shape extended lengthily downward, and is fixed to the finger insertion part and the stick, wherein between the coupling rib and the outer cylinder, there is provided a space into which the upper rib can be inserted, wherein in a state where the application unit is coupled to the middle unit, the coupling rib is spaced from the inner surface of the upper rib, and the outer surface of the upper rib is in contact with an inner surface of the outer cylinder.

In an embodiment of the finger mascara, wherein in an inner side of the lower rib, there is provided a wiper which is capable of scraping a cosmetic material adhered to the stick.

In accordance with another aspect of the present disclosure, a finger mascara comprising: a container in which a cosmetic material for eyelash make-up is contained and whose upper end is opened; an application unit which is coupled to an upper end of the container and into which a user can insert his/her finger to apply a cosmetic material; and a middle unit removably coupling the application unit to the container, wherein the application unit includes, a finger insertion part which provides an insertion space into which the user can insert the finger from an upper side thereof; an outer cylinder which surrounds around the finger insertion part and whose upper end is opened; a plurality of elastic supporting parts which are extended upward from the outer cylinder, capable of wrapping around the finger to be inserted into from the upper side, and can be elastically deformed in a direction away from a central axis of the outer cylinder as the finger is inserted into; a stick extended downward from a point within the inner space of the outer cylinder; and a brush which is capable of being coated with and applying the cosmetic material, wherein the middle unit includes an upper rib to be inserted into an inner side of the outer cylinder, wherein when the application unit is coupled to the middle unit, the finger supporting part is disposed in an inner side of the upper rib.

In accordance with another aspect of the present disclosure, a finger mascara comprising: a container in which a cosmetic material for eyelash make-up is contained and whose upper end is opened; and an application unit which is coupled to an upper end of the container and into which a user can insert his/her finger to apply a cosmetic material, the application unit including a stick provided with a brush to be coated with a cosmetic material, wherein the application unit includes, a finger insertion part which provides an insertion space into which the user can insert the finger from an upper side thereof; a plurality of elastic supporting parts which are extended to an upper side of the finger insertion part, capable of wrapping around the finger to be inserted into from the upper side, and can be elastically deformed; and a tip formed at a free end of the elastic supporting part, the tip being formed so as to be more protruding toward the finger than the elastic supporting part, or being extended to one side or both sides, or being formed with a wider area in a width direction than the elastic supporting part.

Advantageous Effects

According to a finger mascara of the exemplary embodiments of the disclosure, there is an advantage that usage convenience is improved and a manufacturer can improve productivity as one structure can be used for users having different finger sizes.

Further, there is an effect that precise make-up can be done as an application unit can be firmly secured to a finger.

Further, there is an advantage that user's satisfaction is improved as a body portion which the user does not want being smeared with a cosmetic material due to contamination of an outer surface of an application unit by the cosmetic material is prevented.

Further, there is an effect that usage convenience is improved as an application unit and a container can be coupled to and separated from each other.

DESCRIPTION OF DRAWINGS

FIG. 1 is a perspective view showing an outer appearance of a finger mascara according to an embodiment of the disclosure.

FIG. 2 is a partial cross sectional view of the finger mascara of FIG. 1.

FIG. 3 is a front view and a bottom view of an application unit of FIG. 1.

FIG. 4 is a perspective view of a middle unit of FIG. 1 and a development view of an inner surface of an application unit coupling part.

FIG. 5 is a diagram illustrating a coupling process of the application unit and the middle unit of FIG. 1.

FIG. 6 is a cross sectional view showing a state in which a finger is inserted into the application unit of FIG. 2, FIG. 7 is a diagram showing a state in which the application unit of FIG. 2 is separated from the middle unit.

FIG. 8 is a perspective view showing an outer appearance of a finger mascara according to another embodiment of the disclosure.

FIG. 9 is a perspective view showing an outer appearance of a finger mascara according to still another embodiment of the disclosure.

FIG. 10 is a perspective view showing an outer appearance of a finger mascara according to still another embodiment of the disclosure.

BEST MODE

Hereinafter, specific embodiments of the present invention will be explained in detail with reference to the drawings.

Additionally, it is noted that the detailed description for known components or functions may be omitted herein so as not to obscure essential points of the disclosure.

Further, in the following description, an upper direction means an upper direction FIG. 1, and a lower direction means a lower direction based on FIG. 1. These upper direction and lower direction may be described as one side and another side of components.

FIG. 1 is a perspective view showing an outer appearance of a finger mascara according to an embodiment of the disclosure, FIG. 2 is a partial cross sectional view of the finger mascara of FIG. 1, FIG. 3 is a front view and a bottom view of an application unit of FIG. 1, FIG. 4 is a perspective view of a middle unit of FIG. 1 and a development view of an inner surface of an application unit coupling part.

Referring to FIGS. 1 to 4, the finger mascara 1 according to an embodiment of the disclosure may include a container 10 for containing a cosmetic material for eyelash make-up; an application unit 20 coupled to an upper side of the container 10 to be used as a device for applying the cosmetic material by a user inserting his/her finger thereinto; and a middle unit 30 for detachably coupling the application unit 20 to the container 10.

In the embodiment, the finger mascara 1 is understood as a cosmetic product used for a purpose of making eyelashes look long and abundant, wherein the cosmetic material can be applied by a user inserting his/her finger into the application unit 20 and moving his/her finger.

Although the container 10 can be formed in various shapes to contain the cosmetic material, in the embodiment, it is exemplified by a cylindrical one lengthily extended in an up and down direction and with an upper end opened. The container 10 may be formed from a transparent material to check a remained amount of the cosmetic material contained therein, and check whether a brush 24 of the application unit 20 is well coated with the cosmetic material.

The application unit 20, which is configured to apply the cosmetic material after a user inserts his/her finger thereinto, may include an outer cylinder 21 with an upper side opened, a finger insertion part 22 provided inside the outer cylinder 21 to provide a fitting space in which a user can insert his/her finger, a stick 23 extending downward from a lower end of the finger insertion part 22, a brush 24 formed at an end portion of the stick 23 to be coated with the cosmetic material, and a plurality of elastic supporting parts 25 extending upward from the outer cylinder 21 to surround the finger.

The outer cylinder 21 may be formed with a size corresponding to an outer diameter of the container 10 in order to make its outer appearance elegant, and has a cylindrical shape surrounding a portion of the finger insertion part 22 and the stick 23 so as to prevent the portion of the finger insertion part 22 and the stick 23 from being exposed to a direction perpendicular to a extending direction of the stick 23. In this case, a predetermined space may be formed between the finger insertion part 22 and the stick 23, and the outer cylinder 21. In this space, a plurality of coupling ribs 28 may be provided for coupling the application unit 20 to the middle unit 30, and an upper rib 33 of the middle unit 30 to be described later may be inserted into this space.

With these features of the outer cylinder 21, the finger insertion part 22, the stick 23 and the middle unit 30 can be always located only at an inner side of the outer cylinder 21, and thus even when the finger insertion part 22, the stick 23 and the middle unit 30 are smeared with a cosmetic material, an outer circumferential surface of the outer cylinder 21 can be always kept at a clean state. Therefore, a problem that a user's face would be smeared with the cosmetic material which has been smeared on a part except the brush 24, can be prevented.

In the exemplary embodiment, the outer cylinder 21, like the container 10, is described by way of example as being formed with a cylindrical shape having a predetermined height.

The outer cylinder 21 may have an inner diameter corresponding to the outer diameter of the upper rib 33 of the middle unit 30. With this, the outer cylinder 21 may be fitted around and coupled with the upper rib 33 at a predetermined strength. According to an exemplary embodiment, the outer cylinder 21 may have an inner diameter greater than the outer diameter of the upper rib 33, and in such a case, the inner surface of the outer cylinder 21 and the outer surface of the upper rib 33 may not be coupled with each other.

In the inner side of the outer cylinder 21, there is provided the finger insertion part 22 which is capable of accommodating a fingertip when a user inserts his/her finger. The finger insertion part 22 may be spaced from the inner surface of the outer cylinder 21 by a predetermined distance to form the space therebetween, in which the coupling ribs are formed and into which the upper rib is inserted, and may have a shape converging downward so as to correspond to a shape of a finger.

The coupling state between the finger insertion part 22 and the outer cylinder 21 may be maintained, so that, when a user moves his/her finger with the finger inserted into the finger insertion part 22, the entire outer cylinder 21 can be moved. As an example, the finger insertion part 22 may be integrally formed with the outer cylinder 21, and in such a case, the upper portion of the finger insertion part 22 and the upper portion of the outer cylinder 21 may be connected with each other.

The stick 23 is lengthily extended downward from a point in the inner space of the outer cylinder 21, and is appropriately formed to have such a length that the brush 24 provided at the end portion of the stick can be easily coated with the cosmetic material contained in the container 10.

In the exemplary embodiment, the stick 23 is exemplified as being extended lengthily from a lower end center portion of the finger insertion part 23, and as being formed integrally with the finger insertion part 23, but the scope of the invention is not limited thereto. For example, the stick 23 may be connected to the outer cylinder 21, or may have a configuration in which it is inserted into a predetermined insertion hole formed in the finger insertion part 22. Advantageously, in such a case, if the brush 24 is too dirty or damaged to be used for make-up, the stick 23 and the brush 24 can be replaced.

As an upper portion of the outer cylinder 21, there are proved the plurality of elastic supporting parts 25 which are arranged to have a predetermined distance or an angle therebetween, and are extended in a spiral shape to wrap around the finger. In the exemplary embodiment, three elastic supporting parts 25, which are disposed along the periphery of the outer cylinder 21 at 120 degree interval, are provided.

The elastic supporting parts 25 may be formed of a material having a predetermined elasticity, such as a synthetic resin material which can be injection-molded together with the outer cylinder 21. The elastic supporting part 25 may have a predetermined thickness from the upper end periphery of the outer cylinder 21 so as to be elastically deformed with ease, and an lower end of the elastic supporting part 25 may be formed with a wider width than the width of an upper portion thereof in order to ensure durability in repeated use.

The plurality of elastic supporting parts 25 form a space among themselves, through which a finger can be passed, and if a user want to use the application unit 20, the user can enter his/her finger through the space among the plurality of elastic supporting parts 25 and insert it into the finger insertion part 22.

At this time, the plurality of elastic supporting parts 25 can be elastically deformed according to an external force exerted by the finger. That is, when the finger is entered into the finger insertion part 22, the elastic supporting part 25 can be deformed away from a central axial direction of the outer cylinder 21, so that the finger can be supported by the elastic force thereof proportional to the deformation amount. According to this, a user can insert his/her finger easily into the finger insertion part 22 regardless of the thickness of the finger, while at the same time the finger can be supported stably by the elastic supporting part 25, so that eyelash make-up can be precisely performed without shaking of the application unit 20.

In this case, the size of the space provided by the elastic supporting part 25 may be set base on a person having a thin finger, or may be set to be smaller than it.

Meanwhile, the elastic supporting part 25 may be provided at its free end, i.e., an upper end, with a tip 26 which can press the finger. The tip 26 may have a thickness thicker than the thickness of the elastic supporting part 25, and may be formed so as to protrude toward the central axial direction of the outer cylinder 21 beyond the outer cylinder 25. That is, the tip 26 can be protrude toward the finger further than the elastic supporting part 25, and the deformation amount of the elastic supporting part 25 can become greater by the tip 26, so that stronger supporting force can be provided to the finger.

In this case, a height of the tip 26 may be set so that, when the finger of a user is inserted into the finger insertion part 22, the tip 26 can be located at a slightly recessed part in the finger, that is, a middle part between a second joint and a third joint, and for example, a distance between the lower end point of the finger insertion point 22 to a center of the tip 26 may be set to be within a range from 2 cm to 5 cm, so that the tip may be located at the second joint of an index finger.

Further, according to an embodiment, some of the plurality of elastic supporting parts 25 may be formed so as to have a length different from each other, so that some of the tips 26 can be formed to have a different height from each other. With this, the application unit 25 can be supported at various parts of the finger having heights different from each other, so that it can be firmly secured to the finger.

Further, the tip 26 may be formed to be generally rounded, so that a user can feel soft when inserting or extracting the finger.

As described above, the elastic supporting part 25 and the tip 26 are returned to an original state by elastic force when the finger has been extracted.

Meanwhile, in the inner space of the outer cylinder 21, the plurality of coupling ribs 28 may be formed for coupling the application unit 20 to the middle unit 30. In the exemplary embodiment, although four coupling ribs 28 disposed around the stick 23 at 90 degree interval are illustrated by way of an example, the number and the interval of the coupling ribs 28 do not limit the spirit of the invention.

The coupling ribs 28 may be secured to an outer peripheral surface of the finger insertion part 22 and an outer peripheral surface of the stick 23, or according to an exemplary embodiment, may be one of the finger insertion part 22 and the stick 23, or may be formed integrally with the both. In this case, the coupling rib 28 may have a plate shape extending lengthily in an up and down direction, and a lower end of the coupling rib 28 may serve as a protrusion to be inserted into a coupling slot 336 of the middle unit 30 to be described later. In the exemplary embodiment, the coupling rib 28 is described by way of an example as being a plate extending lengthily in the up and down direction, but the spirit of the invention is not limited thereto. For example, the coupling rib 28 may have a rib shape which is protruded from the periphery of the stick 23 and can be inserted into the coupling slot 336.

As in the exemplary embodiment, in a case where the coupling rib 28 is provided in a plate shape secured to the finger insertion part 22 and the stick 23, there are advantages that the load produced when the application unit is inserted or separated can be easily supported, and that the finger insertion part 22 can be more firmly supported.

Meanwhile, a side edge of the coupling rib 28 is formed so as to be spaced from the inner surface of the outer cylinder 21. Into a space between the side edge of the coupling rib 28 and the inner surface of the outer cylinder 21, the upper rib 33 can be inserted, and the insertion-coupling of the upper rib 33 and the outer cylinder 21 can allow the application unit 20 to be more firmly fixed to the middle unit 30.

In addition, in the exemplary embodiment, the side edge of the coupling rib 28 is described as being spaced from the inner surface 332 of the upper rib 33 by a predetermined distance for allowing the coupling rib 28 to be easily inserted into the inside of the upper rib 33, but according to an exemplary embodiment, the side edge of the coupling rib 28 may be in contact with the inner surface 332 of the upper rib 33. In a case where the side edge of the coupling rib 28 is spaced from the inner surface 332 of the upper rib 33, an outer surface of the upper rib 33 may be in contact with the inner surface of the outer cylinder 21 so as to prevent the application unit 20 from being shaken while in a coupled state.

In this case, a lower end of the outer cylinder 21 may be formed so as to have a height position equal to or lower than a lower end of the coupling rib 28, preventing the coupling rib 28 from being exposed to a side. With this, even when the coupling rib 28 becomes dirty by the cosmetic material, the problem that the cosmetic material is smeared on other body part can be effectively prevented.

The middle unit 30 serves as a medium for coupling the container 10 with the application unit 20, and may be formed integrally with the container 10 according to an embodiment.

Specifically, the middle unit 30 may include a base 31 positioned between the container 10 and the application unit 20, a lower rib 32 protruded toward a lower side of the base 31 to be inserted into the container 10, and the upper rib 33 protruded toward an upper side of the base 31 to be inserted into the inside of the outer cylinder 21 of the application unit 20.

The base 31 may have a circular shape with a penetration hole 312 at a center for allowing the penetration of the stick 23, and can be fixed by the edge being seated on the upper end of the container 10.

The lower rib 32 may be formed with a size corresponding to the inner diameter of the container 10, so that the middle unit 30 can be firmly inserted into and coupled with the container 10. In the exemplary embodiment, the coupling of the middle unit 30 and the container 10 is described by way of an example as insertion-coupling, but various known coupling method, such as screw coupling and the like, can be used for the coupling of the middle unit 30 and the container 10.

In the inside of the lower rib 32, there is provided a wiper 34 which is capable of scraping the cosmetic material adhered on the stick 32 when the application unit 20 is separated. At a center of the wiper 34, there is formed a hole through which the stick 23 and the brush 24 can pass, and which can be formed of an elastic material so as to be elastically deformed by friction of the stick 23 and the brush 24. For example, the wiper 34 may be one of natural rubber, elastomer, urethane rubber, NBR (nitrile-butadiene rubber) and silicone. Additionally, the wiper 34 may be provided with a winkle for smooth elastic deformation.

In this case, the wiper 34 may be formed in a configuration where its diameter becomes smaller as it goes down. In this case, the cosmetic material scraped by the wiper 34 may be moved upward and caught in a space between the wiper 34 and the lower rib 32, and on the outer surface of the wiper 34, there is provided a back flow prevention rib (not shown) which may be protrudingly formed so as to be inclined downward in order to drop downward the cosmetic material moving upward along the outer surface of the wiper 34.

Additionally, the wiper 34 may be provided with a recess at an outer circumferential surface so as to enable insertion-coupling with a protrusion formed on an inner circumferential surface of the lower rib 32, but the coupling method of the wiper 34 is not limited thereto.

Further, in the exemplary embodiment, the wiper 34 is described by way of an example as being provided as a separate member, but the wiper 34 may be formed integrally with the lower rib 32 or the base 31. In this case, the space between the wiper 34 and the rib 32 may be omitted or minimized in order to save a submaterial and improve sealing ability.

The upper rib 33 has a cylindrical shape extended upward from the base 31, and when the application unit 20 is coupled to the middle unit 30, the end portion of the finger insertion part 22, the coupling rib 28, and the stick 23 may be disposed within the upper rib 33. Further, the outer diameter of the upper rib 33 is formed so as to correspond to the inner diameter of the outer cylinder 21, so that the insertion-coupling between the outer cylinder 21 and the upper rib 33 can be made to have a predetermined strength. However, the strength of the insertion-coupling between the outer cylinder 21 and the upper rib 33 may be such a level that the coupling can be released by a user applying even a weak force, and for example, the outer cylinder 21 may be coupled to the upper rib 33 to have such a frictional force that the outer cylinder can be rotated around the upper rib 33 only by a user rotating his/her finger.

The inner circumferential surface 332 of the upper rib 28 is provided with the coupling slot 336 for insertion of the coupling rib 28. The coupling slot 336 has such a size that, when the coupling rib 28 is shape-mated with and inserted into the coupling slot 336, the insertion state can be maintained until a predetermined external force is applied.

And the coupling slot 336 has an arrangement corresponding to that of the coupling rib 28. That is, in the exemplary embodiment, the coupling slots 336 are also formed along the inner circumferential surface 332 of the upper rib 33 at a 90 degree interval.

In this case, the coupling slot 336 may be formed to have such a depth that only a portion of the end of the coupling rib 28 can be inserted thereinto, and at a lower side of the coupling slot 336, there may be formed a supporting part 335 which supports the coupling rib 28 when the coupling rib 28 is inserted into the coupling slot 336.

Additionally, between the coupling slots neighboring each other, there is formed a guide 334 which guides the movement of the coupling rib 28 when the application unit 20 is coupled. The guide 334 may be include a plurality of guide surfaces protrudingly formed in a predetermined length from the inner circumferential surface 332 of the upper rib 33 to be convex upward. Specifically, the guide 334 may include the inclined surface leading to the coupling slots 336 of both sides with respect to a summit point 336 located between the coupling slots 336 neighboring each other. In this case, the summit point 338 and the inclined surface may be formed with a curved surface, so that the coupling rib 28 can be guided smoothly.

In this case, even when a user couples the application unit 20 to the middle unit 30 in any direction, the coupling rib 28 is first brought into contact with the guide 334, and guided along the inclined surface of the guide 334 to the coupling slot 336 to be coupled to the coupling slot 336, and thus the user can conveniently couple the application unit 20 and the middle unit 30.

Hereinafter, a method for assembling and a method for using the finger mascara 1 according to an exemplary embodiment of the disclosure having the aforementioned configuration will be described.

FIG. 5 is a diagram illustrating a coupling process of the application unit and the middle unit of FIG. 1, FIG. 6 is a cross sectional view showing a state in which a finger is inserted into the application unit of FIG. 2, FIG. 7 is a diagram showing a state in which the application unit of FIG. 2 is separated from the middle unit.

When describing the method for assembling the finger mascara 1 first with reference to FIGS. 5 to 7, the middle unit 30 is provided while being in a coupling state to the container 10. The lower rib 32 of the middle unit 30 is press-fit into the container 10 so as not to drop out of it, and the coupling between the middle unit 30 and the container 10 can be firmly maintained event though the middle unit 30 and the application unit 20 are repeatedly coupled to and separated from each other.

And the application unit 20 is coupled to the middle unit 30. The application unit 20 is coupled from top to bottom, so that the brush 24 and the stick 23 pass through the penetration hole 312. At this time, the outer cylinder 21 is coupled around the outer circumferential surface of the upper rib 33 of the middle unit 30. Additionally, as the application unit 20 is moved down, the coupling rib 28 is brought into contact with the guide 334, and guided along the inclined surface of the guide 334 to the coupling slot 336. For example, when the coupling rib 28 is brought into contact with the guide 334 as shown (a) in FIG. 5, the contact point is a left portion of the summit point 338, and thus the coupling rib 28 and the application unit 28 are rotated anticlockwise as they are going down.

And, when the user moves the application unit 20 downward by applying an external force, the end portion of the coupling rib 28 is coupled to the coupling slot 336 to be in a state as shown (b) in FIG. 5 and be rest on the supporting part 335. At this time, the lower end of the outer cylinder 21 is also brought into contact with the base 31, and cannot be moved further.

In such coupling state of the application unit 20, the brush 24 can be put into the cosmetic material contained in the container 10, so that the cosmetic material is adhered to the brush 24.

Then, the user, who wants to apply the cosmetic material, inserts his/her finger into the elastic supporting parts 25 and the finger insertion part 22 as shown in FIG. 6, and can separate the application unit 20 from the middle unit 30 by pulling the application unit 20 upward. Specifically, by pulling the application unit 20 upward slightly, the constraint state of the coupling rib 28 and the coupling slot 336 is released, and when being moved further upward, the outer cylinder 21 is escaped from the upper rib 33 and the application unit 20 can be freely extracted.

Meanwhile, the application unit 20 can be separated from the middle unit 30 not by pulling upward but by rotating in one direction relative to the container 10 or the middle unit 30. As the coupling rib 28 is coupled at its end portion to the coupling slot 336, when a user rotates the outer cylinder 21 with his/her finger inserted into the application unit 20, the coupling rib 28 can be elastically deformed by the rotational force applied to the outer cylinder 21 and be extracted from the coupling slot 336. By this action of rotating the application unit 20 in a direction, the coupling rib 28 is extracted from the coupling slot 336, and then the coupling rib 28 is moved along the inclined surface of the guide 334, by which the application unit 20 can be naturally moved upward. In order to facilitate the separation of the coupling rib 28 at the time of this rotating action, the lower end portion of the coupling rib 28 inserted into the coupling rib 336 and an inlet portion of the coupling slot 336 may be rounded. Specifically, when a rotational force is applied to the coupling rib 28, the rounded portion of the coupling rib 28 can be smoothly extracted while sliding on the rounded portion of the inlet portion of the coupling slot 336, thus enabling easier separation.

Hereinafter, operation and effect of the finger mascara 1 according to the exemplary embodiment having such a configuration as described above will be described.

A user can couple and separate the application unit 20, with/from the container 10 and the middle unit 30 in the aforementioned method, and at ordinary time, store the application unit 20 by inserting it in the middle unit 30, whereas at a time of make-up, the user inserts his/her finger into the elastic supporting part 25 and the finger insertion part 22, extracts the application unit 20, and does make-up using the finger.

At this time, as the plurality of elastic supporting parts 25 are provided and are capable of being elastically deformed according to the thickness of a user's finger, the one structure can be used for all users having various finger thicknesses. In particular, as demand of various customers can be satisfied by only one model, a manufacturer of mascara can improve productivity.

Moreover, the elastic supporting part 25 is provided plurally, and can be formed to be extended spirally and wrap the finger entirely, and thus the application unit 20 can be firmly secured to the finger. Therefore, as it is possible to prevent the application unit 20 from being problematically shaken, a user can do more precise make-up.

Further, it is possible to manufacture the elastic supporting part 25 more strongly by extending the elastic supporting part 25 from the outer cylinder 21, thus improving the durability of the product.

In particular, the deformation amount of the elastic supporting part 25 can be increased by the tip 26 provided at the end portion of the elastic supporting part 25, and thus it is possible to support the finger with greater force, improving a fixing property of the application unit 20. Further, by corresponding the position of the tip 26 to a joint of a user's finger, a relatively thin portion of the finger can be supported by the tip 26, and a relatively thick portion of the finger can be supported by the elastic supporting part, by which an entirely stable support can be accomplished.

Further, by employing lengths of the elastic supporting parts 25 different from each other and positions of the tips 26 different from each other, a variety of positions of the finger can be supported at the same time, thus improving the fixing property of the application unit 20 further.

Further, in the prior art, there was a problem that a cosmetic material was smeared on an inlet portion and an application device as the stick and the brush are repeatedly entered into and extracted from the inside of a container. In particular, if a cosmetic material is smeared on an outer circumferential surface of a grip part of a mascara to which the stick fixed, there was a problem that the cosmetic material is frequently smeared on a face. However, in the exemplary embodiment, by forming the outer cylinder 21 and disposing the finger insertion part 22, the coupling rib 28 and the like within the outer cylinder 21, the cosmetic material is not smeared on an outer surface of the application unit 20. Therefore, the problem that a cosmetic material is inadvertently smeared on the face while a user is doing make-up can be prevented.

Furthermore, there is an advantage that a lid of a mascara container can be omitted as the application unit 20 where the outer cylinder 21 and the finger insertion part 22 are formed serves itself as a lid of the container. In particular, when the application unit 20 is coupled to the middle unit 30, the upper rib 33 is inserted into the inside of the outer cylinder 21, so that outside foreign material is prevented from entering the inside of the container 10. In this case, inconvenience that a user should keep a lid separately while using a mascara can be removed, thus improving a user convenience.

Further, although a user inserts the application unit 20 into the middle unit 30 in any direction at the time of coupling the application unit 20, the coupling rib 28 can be guided along the guide 334 to the coupling slot 336, and at the time of separation, the application unit 20 can be separated only by pulling the application unit 20, thus allowing the user to use the application unit 20 while simply and conveniently attaching and detaching the application unit 20 to/from the container 10.

Particularly, the user can release the coupling of the coupling rib 28 and the coupling slot 336 only by the action of rotating the application unit 20, and in this case, the coupling rib 28 is guided along the guide 334 while at the same time the application unit 20 is moved upward, and thus the user can more conveniently separate from the container 10 and use the application unit 20.

Hereinafter, a finger mascara according to another exemplary embodiment of the disclosure will be described with reference to FIG. 8. However, as another exemplary embodiment of FIG. 8 is different from the exemplary embodiment of FIG. 1 in a configuration of the elastic supporting part and the tip, such different features will be mainly described, while reference to the above-described embodiment will be made for the description and reference signs of same parts.

FIG. 8 is a perspective view showing an outer appearance of a finger mascara according to another embodiment of the disclosure.

Referring to FIG. 8, an elastic supporting part 25*a* of the finger mascara 1*a* according to another embodiment of the disclosure has a shape extended linearly toward an upper side of an application unit 20*a*. And a tip 26*a* may be provided at an end portion of the elastic supporting part 25*a*, and be extended perpendicular to the elastic supporting part 25*a* and to both lateral sides of the elastic supporting part 25*a*. That is, the elastic part 25*a* and the tip 26*a* may be formed in a T shape. With this structure, a user's finger can be wrapped around at a greater range in a circumferential direction, and thus the application unit 20*a* can be secured to the finger more stably.

Further, some of the plurality of elastic supporting parts 25*a* and others may be formed to have heights different from each other, and some of the plurality of tips 26*a* may be arranged so as to overlap each other in a length direction of the finger. With this configuration, the finger can be supported at various positions in the length direction as well as the circumferential direction.

Hereinafter, a finger mascara according to another exemplary embodiment of the disclosure will be described with reference to FIG. 9. However, as another exemplary embodiment of FIG. 9 is different from the exemplary embodiment of FIG. 1 in a configuration of the elastic supporting part and the tip, such different features will be mainly described, while reference to the above-described embodiment will be made for the description and reference signs of same parts.

FIG. 9 is a perspective view showing an outer appearance of a finger mascara according to still another embodiment of the disclosure.

Referring to FIG. 9, an elastic supporting part 25*b* of the finger mascara 1*b* according to still another embodiment of the disclosure has a shape extended in a straight line shape toward an upper side of an application unit 20*b*. And a tip 26*b* may be provided at an end portion of the elastic supporting part 25*b*, and be extended perpendicular to the elastic supporting part 25*b* and to a lateral side of the elastic supporting part 25*b*. That is, the elastic part 25*b* and the tip 26*b* may be formed in an inverted L shape. With this structure, a user's finger can be wrapped around at a greater range in a circumferential direction, and thus the application unit 20*b* can be secured to the finger more stably.

Hereinafter, a finger mascara according to another exemplary embodiment of the disclosure will be described with reference to FIG. 10. However, as another exemplary embodiment of FIG. 10 is different from the exemplary embodiment of FIG. 1 in a configuration of the elastic supporting part and the tip, such different features will be mainly described, while reference to the above-described embodiment will be made for the description and reference signs of same parts.

FIG. 10 is a perspective view showing an outer appearance of a finger mascara according to still another embodiment of the disclosure.

Referring to FIG. 10, an elastic supporting part 25*c* of the finger mascara 1*c* according to still another embodiment of the disclosure may be formed in a shape whose width is gradually increased toward an upper side of the application unit 20*c*, and may be provided in a curved shape so as to wrap around the finger more stably. And the tip 26*c* may be a portion formed at an end portion of the elastic supporting part 25*c* wider in a width direction than the elastic supporting part 25*c*, and the elastic supporting part 25*c* and the tip 26*c* may be formed continuously and a boundary therebetween may be unclear. With this structure, a user's finger can be wrapped around at a greater range in a circumferential direction, and thus the application unit 20*c* can be secured to the finger more stably.

Followings are a list of exemplary embodiments of the disclosure.

Item 1 is a finger mascara comprising: a container in which a cosmetic material for eyelash make-up is contained and whose upper end is opened; an application unit which is coupled to an upper end of the container and into which a user can insert his/her finger to apply a cosmetic material; and a middle unit removably coupling the application unit to the container, wherein the application unit includes, a finger insertion part which provides an insertion space into which the user can insert the finger from an upper side thereof; an outer cylinder which surrounds around the finger insertion part and whose upper end is opened; a plurality of elastic supporting parts which are extended upward from the outer cylinder, capable of wrapping around the finger to be inserted into from the upper side, and can be elastically deformed in a direction away from a central axis of the outer cylinder as the finger is inserted into; a stick extended downward from a point within the inner space of the outer cylinder; and a brush which is capable of being coated with and applying the cosmetic material, wherein the middle unit includes an upper rib to be inserted into an inner side of the outer cylinder, wherein when the application unit is coupled to the middle unit, the finger supporting part is disposed in an inner side of the upper rib.

Item 2 is a finger mascara comprising: a container in which a cosmetic material for eyelash make-up is contained and whose upper end is opened; and an application unit which is coupled to an upper end of the container and into which a user can insert his/her finger to apply a cosmetic material, the application unit including a stick provided with a brush to be coated with a cosmetic material, wherein the application unit includes, a finger insertion part which provides an insertion space into which the user can insert the finger from an upper side thereof; a plurality of elastic supporting parts which are extended to an upper side of the finger insertion part, capable of wrapping around the finger to be inserted into from the upper side, and can be elastically deformed; and a tip formed at a free end of the elastic supporting part, the tip being formed so as to be more protruding toward the finger than the elastic supporting part, or being extended to one side or both sides, or being formed with a wider area in a width direction than the elastic supporting part.

Item 3 is a finger mascara comprising: a container in which a cosmetic material for eyelash make-up is contained and whose upper end is opened; an application unit which is coupled to an upper end of the container and into which a user can insert his/her finger to apply a cosmetic material; and a middle unit removably coupling the application unit to the container, wherein the application unit includes, a finger insertion part which provides an insertion space into which the user can insert the finger from an upper side thereof; an outer cylinder which surrounds around the finger insertion part and whose upper end is opened; a plurality of elastic supporting parts which are extended upward from the outer cylinder, capable of wrapping around the finger to be inserted into from the upper side, and can be elastically deformed in a direction away from a central axis of the outer cylinder as the finger is inserted into; a stick extended downward from a point within the inner space of the outer cylinder; and a brush which is capable of being coated with and applying the cosmetic material, wherein at a free end of the elastic supporting part, there is provided a tip which is formed so as to be more protruding toward the finger than the elastic supporting part, or which is extended to one side or both sides, or which is formed with a wider area in a width direction than the elastic supporting part.

Item 4 is a finger mascara comprising: a container in which a cosmetic material for eyelash make-up is contained and whose upper end is opened; an application unit which is coupled to an upper end of the container and into which a user can insert his/her finger to apply a cosmetic material; and a middle unit removably coupling the application unit to the container, wherein the application unit includes, a finger insertion part which provides an insertion space into which the user can insert the finger from an upper side thereof; an outer cylinder which surrounds around the finger insertion part and whose upper end is opened; a plurality of elastic supporting parts which are extended upward from the outer cylinder, capable of wrapping around the finger to be inserted into from the upper side, and can be elastically deformed in a direction away from a central axis of the outer cylinder as the finger is inserted into; a stick extended downward from a point within the inner space of the outer cylinder; and a brush which is capable of being coated with and applying the cosmetic material, wherein the middle unit includes, a base provided between the container and the application unit, and provided with a through hole through which the stick and the brush pass; a lower rib which is extended to a lower side of the base to be coupled to the container; and an upper rib which is extended to an upper side of the base to be inserted into an inner side of the outer cylinder, wherein the upper rib is inserted into a space between the finger insertion part and the outer cylinder.

Item 5 is the finger mascara of items 1 to 4, wherein the elastic supporting parts are disposed along the periphery of the outer cylinder at a constant interval therebetween.

Item 6 is the finger mascara of items 1 to 5, wherein the elastic supporting part is extended in a spiral shape in a circumferential direction of the finger.

Item 7 is the finger mascara of items 1 to 6, wherein some of the plurality of elastic supporting parts are formed to have lengths different from each other.

Item 8 is the finger mascara of items 1 to 7, wherein some of the plurality of elastic supporting parts are arranged so as to overlap each other in a length direction of the finger.

Item 9 is the finger mascara of items 1 to 8, wherein a distance from a lower point of the finger insertion part to a center of the tip is from 2 cm to 5 cm.

Item 10 is the finger mascara of items 1 to 9, wherein a plurality of coupling ribs are provided around the stick, wherein on an inner circumferential surface of the upper rib, there are provided a plurality of coupling slots into which the coupling rib is selectively inserted.

Item 11 is the finger mascara of items 1 to 10, wherein the outer cylinder is formed so as to have a height equal to or lower than an end portion of the coupling rib.

Item 12 is the finger mascara of item 1 to 11, wherein on an inner circumferential surface of the upper rib, a guide which guides movement of the coupling rib is protrudingly formed from the inner circumferential surface, wherein the guide is provided between the coupling slots to include a plurality of guide surface, wherein the guide surface is provided with an inclined surface extended to the coupling slots of both sides with respect to a summit point located between the coupling slots.

Item 13 is the finger mascara of items 1 to 12, wherein the coupling rib is configured to be elastically deformed and extracted from the coupling slot by a rotational force applied to the outer cylinder, wherein the coupling rib goes up along the guide surface after having been extracted from the coupling slot.

Item 14 is the finger mascara of items 1 to 13, wherein the coupling rib has a plate shape extended lengthily downward, and is fixed to the finger insertion part and the stick, wherein between the coupling rib and the outer cylinder, there is provided a space into which the upper rib can be inserted, wherein in a state where the application unit is coupled to the middle unit, the coupling rib is spaced from the inner surface of the upper rib, and the outer surface of the upper rib is in contact with an inner surface of the outer cylinder.

Item 15 is the finger mascara of items 1 to 14, wherein in an inner side of the lower rib, there is provided a wiper which is capable of scraping a cosmetic material adhered to the stick.

While the finger mascaras according to examples of the disclosure are described as concrete embodiments, these are just exemplary embodiments, and the present invention should be construed in broadest scope based on the fundamental ideas disclosed herein, rather than being limited to them. By combining or replacing a part or parts of embodiments disclosed herein, ordinary skilled in the art may carry out a type of form which is not explicitly described herein, and however, it should be noted that it is not depart from the scope of the present invention. Besides, ordinary skilled in the art may easily change or modify embodiments disclosed herein based on the disclosure, and however, it is obvious that such change or modification also falls within the scope of the present invention.

INDUSTRIAL APPLICABILITY

The present invention can be used in the cosmetics industry.

The invention claimed is:

1. A finger mascara comprising:

a container in which a cosmetic material for eyelash make-up is contained and whose upper end is opened;

an application unit which is coupled to an upper end of the container and into which a user can insert his/her finger to apply a cosmetic material; and a middle unit removably coupling the application unit to the container, wherein the application unit includes, a finger insertion part which provides an insertion space into which the user can insert the finger from an upper side thereof;

an outer cylinder which surrounds around the finger insertion part and whose upper end is opened;

a plurality of elastic supporting parts which are extended upward from the outer cylinder, capable of wrapping around the finger to be inserted into from the upper side, and can be elastically deformed in a direction away from a central axis of the outer cylinder as the finger is inserted into;

a stick extended downward from a point within the inner space of the outer cylinder; and a brush which is capable of being coated with and applying the cosmetic material, wherein at a free end of the elastic supporting part, there is provided a tip which is formed so as to be more protruding toward the finger than the elastic supporting part, or which is extended to one side or both sides, or which is formed with a wider area in a width direction than the elastic supporting part, wherein the middle unit includes, a base provided between the container and the application unit; and an upper rib which is extended to an upper side of the base;

wherein a predetermined space is formed between the finger insertion part and the outer cylinder, and the upper rib of the middle unit inserted into the predetermined space.

2. The finger mascara of claim 1, wherein the elastic supporting parts are disposed along the periphery of the outer cylinder at a constant interval therebetween.

3. The finger mascara of claim 1, wherein the elastic supporting part is extended in a spiral shape in a circumferential direction of the finger.

4. The finger mascara of claim 1, wherein some of the plurality of elastic supporting parts are formed to have lengths different from each other.

5. The finger mascara of claim 1, wherein some of the plurality of elastic supporting parts are arranged so as to overlap each other in a length direction of the finger.

6. The finger mascara of claim 1, wherein a distance from a lower point of the finger insertion part to a center of the tip is from 2 cm to 5 cm.

7. A finger mascara comprising:

a container in which a cosmetic material for eyelash make-up is contained and whose upper end is opened;

an application unit which is coupled to an upper end of the container and into which a user can insert his/her finger to apply a cosmetic material; and a middle unit removably coupling the application unit to the container, wherein the application unit includes, a finger insertion part which provides an insertion space into which the user can insert the finger from an upper side thereof;

an outer cylinder which surrounds around the finger insertion part and whose upper end is opened;

a plurality of elastic supporting parts which are extended upward from the outer cylinder, capable of wrapping around the finger to be inserted into from the upper side, and can be elastically deformed in a direction away from a central axis of the outer cylinder as the finger is inserted into;

a stick extended downward from a point within the inner space of the outer cylinder; and a brush which is capable of being coated with and applying the cosmetic material, wherein the middle unit includes, a base provided between the container and the application unit, and provided with a through hole through which the stick and the brush pass;

a lower rib which is extended to a lower side of the base to be coupled to the container; and an upper rib which is extended to an upper side of the base to be inserted into an inner side of the outer cylinder, wherein the upper rib is inserted into a space between the finger insertion part and the outer cylinder, wherein a predetermined space is formed between the finger insertion part and the outer cylinder, and the upper rib of the middle unit inserted into the predetermined space.

8. The finger mascara of claim 7, wherein a plurality of coupling ribs are provided around the stick, wherein on an inner circumferential surface of the upper rib, there are provided a plurality of coupling slots into which the coupling rib is selectively inserted.

9. The finger mascara of claim 8, wherein the outer cylinder is formed so as to have a height equal to or lower than an end portion of the coupling rib.

10. The finger mascara of claim 8, wherein on an inner circumferential surface of the upper rib, a guide which guides movement of the coupling rib is protrudingly formed from the inner circumferential surface, wherein the guide is provided between the coupling slots to include a plurality of guide surface, wherein the guide surface is provided with an inclined surface extended to the coupling slots of both sides with respect to a summit point located between the coupling slots.

11. The finger mascara of claim 10, wherein the coupling rib is configured to be elastically deformed and extracted from the coupling slot by a rotational force applied to the outer cylinder, wherein the coupling rib goes up along the guide surface after having been extracted from the coupling slot.

12. The finger mascara of claim 8, wherein the coupling rib has a plate shape extended lengthily downward, and is fixed to the finger insertion part and the stick, wherein between the coupling rib and the outer cylinder, there is provided a space into which the upper rib can be inserted, wherein in a state where the application unit is coupled to the middle unit, the coupling rib is spaced from the inner surface of the upper rib, and the outer surface of the upper rib is in contact with an inner surface of the outer cylinder.

13. The finger mascara of claim 7, wherein in an inner side of the lower rib, there is provided a wiper which is capable of scraping a cosmetic material adhered to the stick.

14. A finger mascara comprising:

a container in which a cosmetic material for eyelash make-up is contained and whose upper end is opened;

an application unit which is coupled to an upper end of the container and into which a user can insert his/her finger to apply a cosmetic material; and a middle unit removably coupling the application unit to the container, wherein the application unit includes, a finger insertion part which provides an insertion space into which the user can insert the finger from an upper side thereof;

an outer cylinder which surrounds around the finger insertion part and whose upper end is opened;

a plurality of elastic supporting parts which are extended upward from the outer cylinder, capable of wrapping around the finger to be inserted into from the upper side, and can be elastically deformed in a direction away from a central axis of the outer cylinder as the finger is inserted into;

a stick extended downward from a point within the inner space of the outer cylinder; and a brush which is capable of being coated with and applying the cosmetic material, wherein the middle unit includes an upper rib to be inserted into an inner side of the outer cylinder, wherein when the application unit is coupled to the middle unit, the finger supporting part is disposed in an inner side of the upper rib, wherein a predetermined space is formed between the finger insertion part and the outer cylinder, and the upper rib of the middle unit inserted into the predetermined space.

15. A finger mascara comprising:

a container in which a cosmetic material for eyelash make-up is contained and whose upper end is opened; and an application unit which is coupled to an upper end of the container and into which a user can insert his/her finger to apply a cosmetic material, the application unit including a stick provided with a brush to be coated with a cosmetic material, wherein the application unit includes, a finger insertion part which provides an insertion space into which the user can insert the finger from an upper side thereof;

a plurality of elastic supporting parts which are extended to an upper side of the finger insertion part, capable of wrapping around the finger to be inserted into from the upper side, and can be elastically deformed; and a tip formed at a free end of the elastic supporting part, the tip being formed so as to be more protruding toward the finger than the elastic supporting part, or being extended to one side or both sides, or being formed with a wider area in a width direction than the elastic supporting part, wherein the middle unit includes, a base provided between the container and the application unit; and an upper rib which is extended to an upper side of the base;

wherein a predetermined space is formed between the finger insertion part and the outer cylinder, and the upper rib of the middle unit inserted into the predetermined space.

* * * * *